US006210131B1

(12) United States Patent
Whitehead

(10) Patent No.: US 6,210,131 B1
(45) Date of Patent: Apr. 3, 2001

(54) FLUID INTENSIFIER HAVING A DOUBLE ACTING POWER CHAMBER WITH INTERCONNECTED SIGNAL RODS

(75) Inventor: John C. Whitehead, Davis, CA (US)

(73) Assignee: The Regents of the University of California, Oakland, CA (US)

( * ) Notice: Subject to any disclaimer, the term of this patent is extended or adjusted under 35 U.S.C. 154(b) by 0 days.

(21) Appl. No.: 09/363,080

(22) Filed: Jul. 28, 1999

(51) Int. Cl.[7] ..... F04B 17/00; F04B 35/00
(52) U.S. Cl. ..... 417/397; 417/342; 417/404
(58) Field of Search ..... 417/397, 246, 417/342, 534, 390, 344, 403, 46, 225, 404; 91/388; 123/53 BP; 60/547.1

(56) References Cited

U.S. PATENT DOCUMENTS

| | | | | |
|---|---|---|---|---|
| 3,740,169 | * | 6/1973 | Papen | 417/397 |
| 4,003,679 | * | 1/1977 | McManigill | 417/246 |
| 4,152,971 | * | 5/1979 | Leonard | 91/388 |
| 4,527,959 | * | 7/1985 | Whiteman | 417/342 |
| 4,747,758 | * | 5/1988 | Saurwein | 417/397 |
| 4,820,136 | * | 4/1989 | Saurwein | 417/397 |
| 5,007,812 | * | 4/1991 | Hartt | 417/534 |
| 5,044,894 | * | 9/1991 | Field et al. | 417/310 |
| 5,113,808 | * | 5/1992 | Eickmann | 123/53 BP |
| 5,273,405 | * | 12/1993 | Chalmers et al. | 417/397 |
| 5,348,451 | * | 9/1994 | Mohn | 417/390 |
| 5,427,507 | * | 6/1995 | Whitehead | 417/344 |
| 5,460,491 | * | 10/1995 | Kitsnik | 417/403 |
| 5,616,005 | * | 4/1997 | Whitehead | 417/46 |
| 5,806,314 | * | 9/1998 | Younes | 60/547.1 |
| 5,879,137 | * | 3/1999 | Yie | 417/225 |

* cited by examiner

*Primary Examiner*—Teresa Walberg
*Assistant Examiner*—Leonid Fastovsky
(74) *Attorney, Agent, or Firm*—Alan H. Thompson; L. E. Carnahan

(57) ABSTRACT

A fluid driven reciprocating apparatus having a double acting power chamber with signal rods serving as high pressure pistons, or to transmit mechanical power. The signal rods are connected to a double acting piston in the power chamber thereby eliminating the need for pilot valves, with the piston being controlled by a pair of intake-exhaust valves. The signal rod includes two spaced seals along its length with a vented space therebetween so that the driving fluid and driven fluid can't mix, and performs a switching function to eliminate separate pilot valves. The intake-exhaust valves can be integrated into a single housing with the power chamber, or these valves can be built into the cylinder head only of the power chamber, or they can be separate from the power chamber.

15 Claims, 5 Drawing Sheets

FLUID INTENSIFIER HAVING A DOUBLE ACTING POWER CHAMBER WITH INTERCONNECTED SIGNAL RODS

The United States Government has rights in this invention pursuant to Contract No. W-7405-ENG-48 between the United States Department of Energy and the University of California for the operation of Lawrence Livermore National Laboratory.

BACKGROUND OF THE INVENTION

The present invention relates to fluid driven reciprocating apparatus, particularly to a fluid intensifier, and more particularly to a fluid driven reciprocating apparatus having a double acting power chamber with connected signal rods functioning as high pressure pistons or to transmit reciprocating mechanical power.

In industry, high pressure fluid, which includes air, water, and hydraulic fluid, has many application. For example, delivering fluid at a high pressure is often accomplished with an intensifier, which is a reciprocating fluid device having one or more large pistons connected to one or more small pistons. Intensifiers are powered by a low pressure fluid, such as compressed air or running water. Intensifiers can operate at any flow rate and still maintain their high pressure output, whereas this would be difficult to achieve with a high pressure pump driven by an electric motor, for example.

One common arrangement for an intensifier is one large double-acting low pressure power cylinder containing a piston which has a rod protruding from each face which are each connected to a small piston within a high pressure pumping cylinder. These prior art intensifiers generally have a single 4-way valve which switches both ends of the power chamber between intake and exhaust. The 4-way valve is controlled by one or two small pilot valves which are actuated by the main piston when it reaches either end of its stroke. These prior art intensifiers are relatively complicated.

One example of a market which can benefit from low cost intensifiers are homes having remote water supplies and no cheap source of electricity to pump water to the homes. If, for example, the homes are located on a hill and the water supply is running water in a stream bed at a lower elevation, intensifiers are commonly used to lift the water from the stream bed to a storage tank for the homes. In such instances, the intensifier is located at a lower elevation than the stream bed and is connected via a short pipe having its inlet located in the stream bed (e.g. to provide 10 meters of head water) which can pump water up the hill (e.g. 100 meters above the intensifier). Such commercial intensifiers are known in the art, as exemplified by the High Lifter Water Pump, Real Goods, 1991 Sourcebook, page 219, and U.S. Pat. No. 4,523,895 and U.S. Pat. No. 4,627,794. Other applications for fluid intensifiers include hydraulic and pneumatic applications, as well as for pressure amplifiers and booster pumps.

The present invention involves a fluid intensifier which is of a less complicated structure, and this in view of its simpler construction is lower in cost when compared to the existing commercial units. The present invention is a fluid driven reciprocating apparatus having a single double acting power chamber having a double acting piston which is connected to signal rods which also function as high pressure pistons or to transmit mechanical power. Optionally, only one rod may be used as a pump or power transmitter. When used as an intensifier the signal rods, which each include a pair of spaced seals or sealable members between which is located a vent, in addition to being high pressure pistons, provide a dual use as valve switching mechanisms, thereby replacing the conventionally used pilot valves. The double acting power chamber utilizes two separate intake-exhaust valves controlled by movement of the signal rods. The high pressure section of the apparatus includes two sets of inlet-outlet valves, and by the use of the vents controlled by the signal rods, the driving fluid and driven fluid can't mix.

SUMMARY OF THE INVENTION

It is an object of the present invention to provide an improved fluid intensifier.

A further object of the invention is to provide a fluid driven reciprocating apparatus having signal rods, that can function as a fluid intensifier or as a mechanical power transmitter.

A further object of the invention is to provide a double acting fluid driven apparatus having a double acting piston with connected signal rods which perform a switching function for intake-exhaust valves for the double acting piston, thereby eliminating separate pilot valves.

Another object of the invention is to provide a fluid driven reciprocating apparatus which includes a double acting piston controlled by a pair of intake-exhaust valves, and to which are connected a pair of signal rods which may function as high pressure fluid pistons and serve to control the intake-exhaust valves.

Another object of the invention is to provide a fluid intensifier or mechanical power transmitter which eliminates conventional 4-way valves and pilot valves, thus simplifying the construction and reducing the costs compared to conventional fluid intensifiers.

Other objects and advantages of the present invention will become apparent from the following description and accompanying drawings. The invention involves a fluid driven reciprocating apparatus having a double acting power chamber with connected opposed signal rods serving as high pressure pistons or for power transmission, and which eliminates the conventional pilot valves for the double acting power chamber. The dual use of the signal rods for valve switching and as high pressure pistons, for example, results in an intensifier which is simpler in construction and lower in cost compared to existing fluid intensifiers. The invention may use the opposite rods as signal rods, but use only of the rods as a pump or power rod. The double acting power chamber is controlled by a pair of intake-exhaust valves switched by the signal rods and thereby replaces the complex prior art 4-way valves.

BRIEF DESCRIPTION OF THE DRAWINGS

The accompanying drawings, which are incorporated into and form a part of the disclosure, illustrate embodiments of the invention and, together with the description, serve to explain the principles of the invention.

DETAILED DESCRIPTION OF THE INVENTION

The present invention involves a fluid driven reciprocating apparatus which can be utilized as a fluid intensifier or as a transmitter of mechanical power. The reciprocating apparatus can be driven by air, water, and hydraulic fluid, and includes a large double-acting piston located in a cylinder, and to which a pair of opposed rods are connected, and each rod provided with a pair of opposed spaced smaller piston-like members or seals which reciprocate in opposed cylinders which includes a vent located intermediate the piston-like members or seals. Movement of the large double-acting piston is controlled by a pair of intake-exhaust valve assemblies which are actuated by movement of said rods. For application as a fluid intensifier, each of the cylinders containing the rods also contain inlet-outlet valve assemblies. Thus, the opposed rods and piston-like members or seals function as high pressure pumps and as signal rods for the large double-acting piston.

The invention is described hereinafter and illustrated as a fluid intensifier, wherein the large double-acting piston is driven by low pressure fluid, such as a head of running water in a stream bed, and the opposed rods with the piston-like members or seals function as high pressure pistons to pump the running water to a point of use, such as a storage tank, for example. The fluid intensifier of the present invention achieves similar results as prior intensifiers, but with less complexity, greater performance advantages, and at lower costs due to the relative simplicity of construction.

The present invention, for example, utilizes two separate intake-exhaust valve assemblies to control the intake and exhaust of the large cylinder, rather than the previously used complex 4-way valves. This invention eliminates the need for the prior used pilot valves by making use of the spaced piston-like members or seals on the opposed rods to control the pair of intake-exhaust valve assemblies depending on piston position and the state of pressurization in each end of the power chamber containing the large double-acting piston. Note that because each rod has two piston-like members or seals along its length with a vented space in between, the driving fluid and driven fluid can't mix. The opposed rods perform a switching function to eliminate separate pilot valves.

Another difference between the present invention and the prior art fluid intensifiers is that the main (double-acting) piston doesn't impact any hard stop at the end of a stroke, which can be an advantage for high speed operation. In the prior art intensifiers the main piston typically impacts the pilot valves at each end of the double strokes, and makes subsequently hard stops when the pilot valves reach the end of their stroke.

Figure 1:
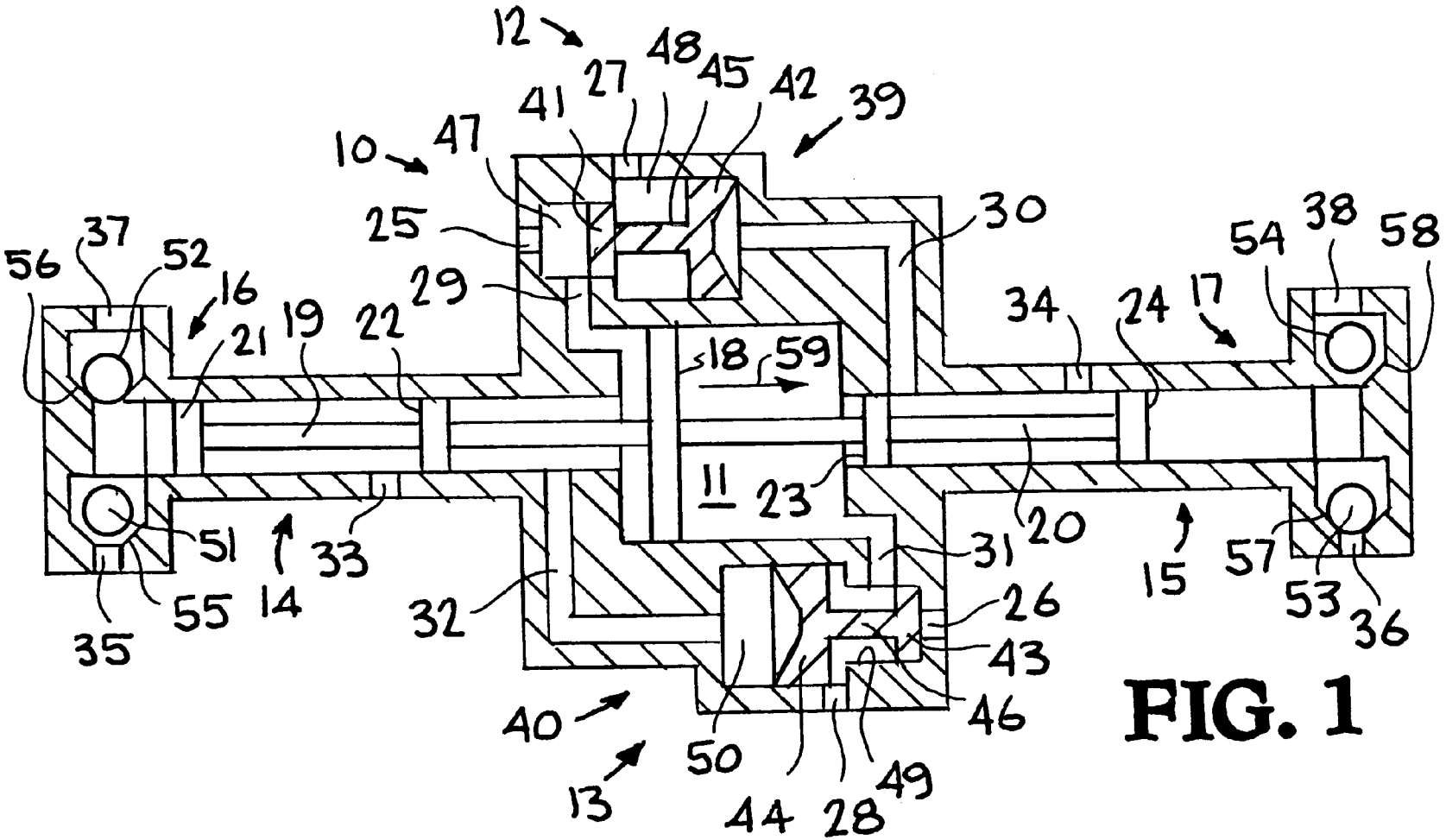
FIGS. 1, 2, and 3 schematically illustrate in cross-section one-half cycle of oscillation of an embodiment of a fluid intensifier made in accordance with the present invention.
Figure 2:
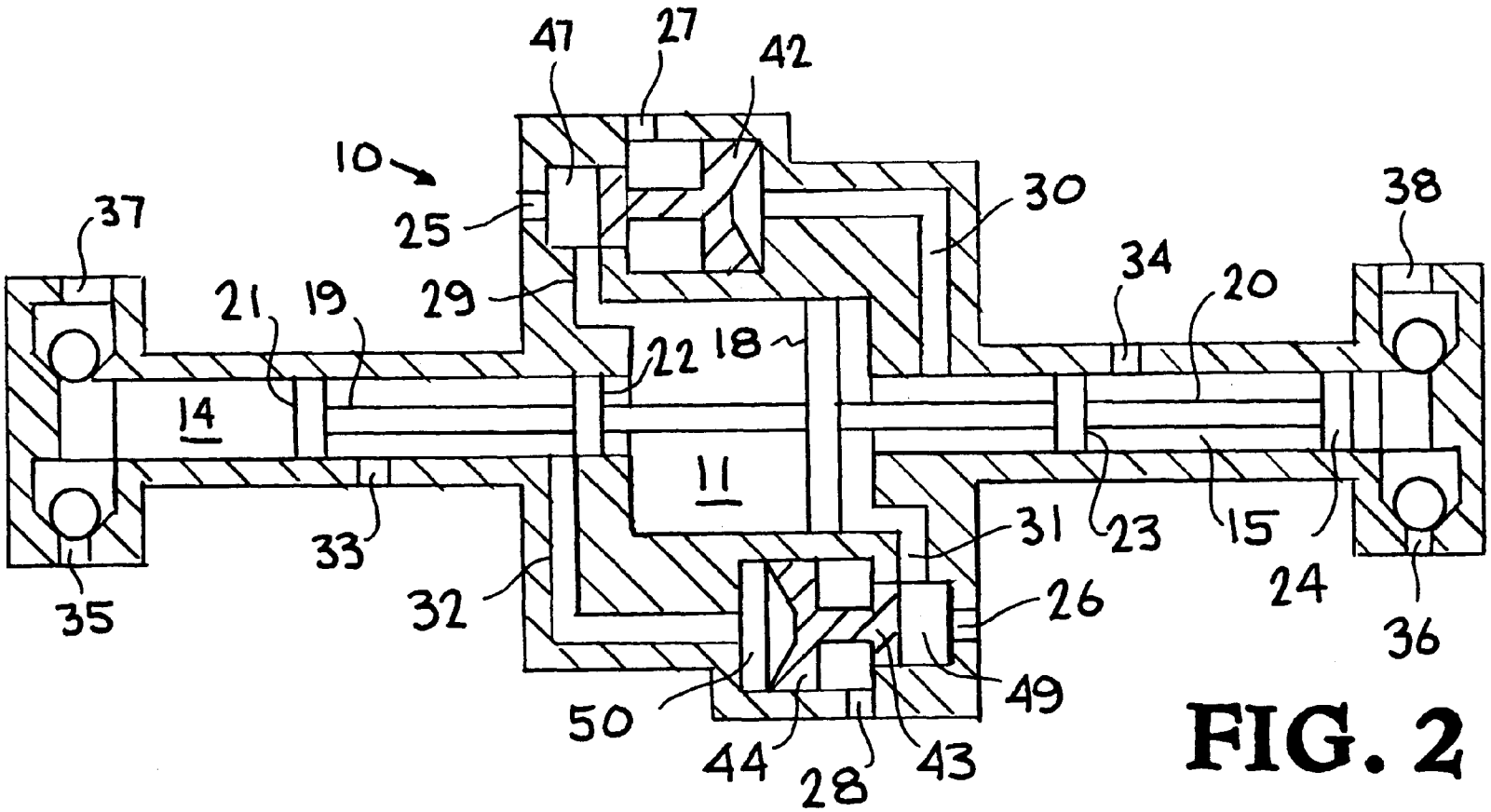
Figure 3:
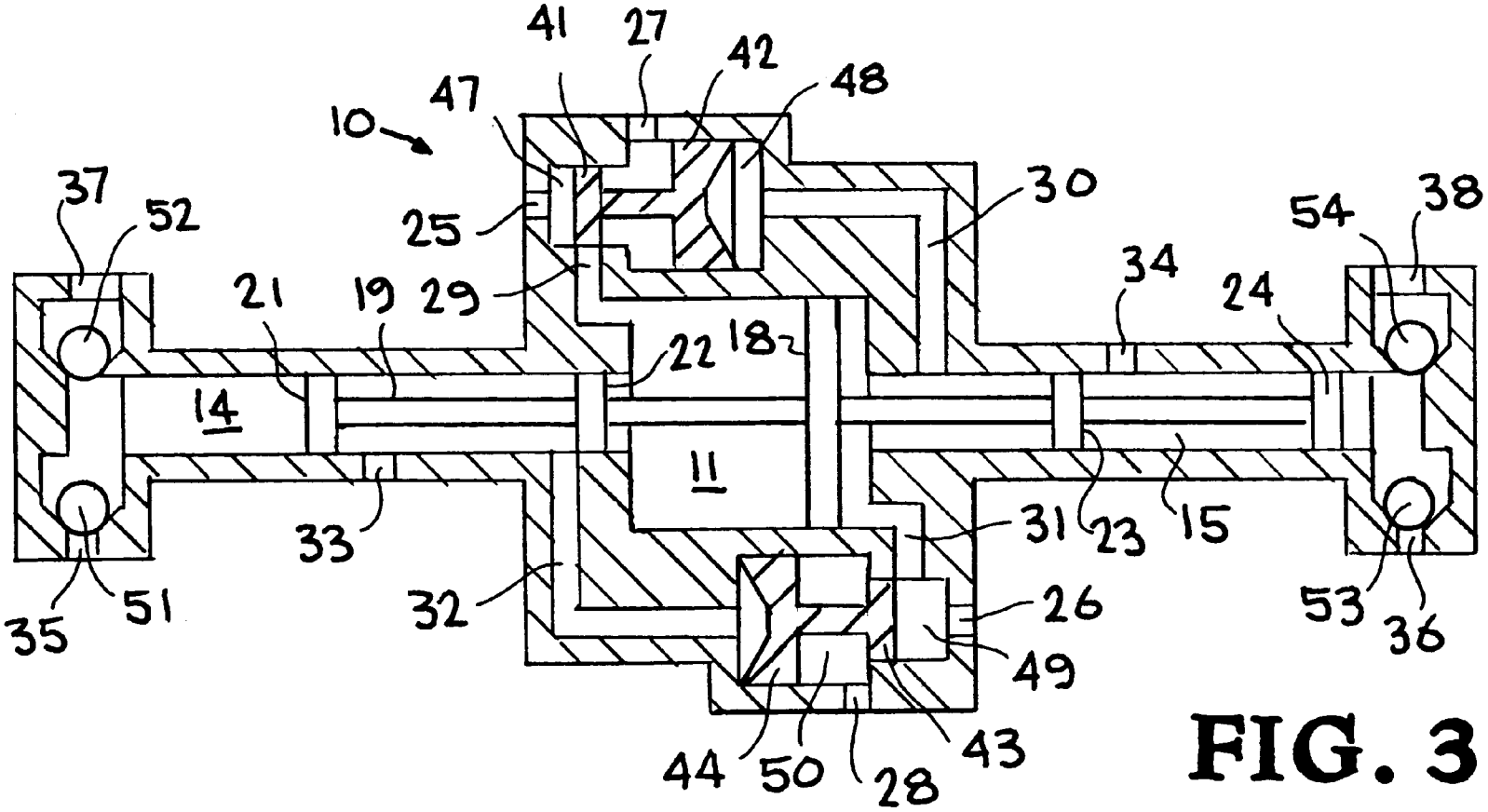

An embodiment of the present invention is schematically illustrated in FIGS. 1–3, described in detail hereinafter, but only one-half cycle of oscillation which is sufficient to provide an understanding of the operation thereof. It is understood that the housing shown must be made of multiple pieces to permit manufacture and assembly, and such can be carried out by those skilled in the manufacturing art. Also, the seal or piston-like members located on the rods are provided with fluid seals such as o-rings to prevent leakage about the moving parts. Also, valve seats, which are well known in the art, could be included in the pair of intake-exhaust valve assemblies as an alternative to or to supplement the reciprocating seals or piston-like members therein.

FIGS. 1–3 illustrate the intake-exhaust valve assemblies as being integrated into the same housing as the large double-acting piston and the opposed rods. Alternately, these valve assemblies can each be located in a cylinder head of the power chamber (cylinder), or they can be located in separate housings, as illustrated in the embodiment of FIGS. 4–7.

Replacing the prior art 4-way valve, which is typically a spool valve with reciprocating seals, with separate intake-exhaust valves provides for a performance advantage because the separate valves of this invention have larger flow areas than similarly sized spool valves. Also, each valve in this invention can be located close to its cylinder head, located at opposite ends of the double-acting piston, so that long flow passageways from the cylinder head to the valve are eliminated. The resulting reductions in pressure losses in the driving fluid is an advantage when the driving fluid is viscous (e.g. water), or when high speed operation is desired. Thus, the present invention can provide a higher output for a given intensifier size.

If in utilizing the present invention, there is an exhaust restriction causing the exhausting side of the power chamber to be pressurized to a large fraction of the driving pressure, such could inadvertently shut the intake valve on the driving side, depending on the area ratio of the ends of the moving valve part, and thus any exhaust restriction should be avoided. Further, exhaust restrictions are normally avoided since power would be wasted in pumping the exhaust out of the chamber.

Referring now to the drawings, FIGS. 1–3 illustrate in cross-section an embodiment of the present invention configured as a fluid intensifier, and as pointed out above only show one-half cycle of oscillation. As shown in FIGS. 1–3, the fluid intensifier is mounted in a single housing generally indicated at 10 in which located a power chamber or cylinder 11, a pair of intake-exhaust valve chambers 12 and 13, and pair of high pressure chambers or cylinders 14 and 15, and a pair of fluid inlet-outlet valve chambers 16 and 17. Reciprocally mounted in power chamber 11 is a double acting piston 18 having signal rods 19 and 20 connected thereto and which extend into high pressure cylinders 14 and 15, and on each are mounted a pair of spaced members or pistons 21–22 and 23–24. The housing 10 includes a pair of power fluid supply or intake ports 25 and 26 connected to valve chambers 12 and 13, and a pair of power fluid exhaust ports 27 and 28, also connected to valve chambers 12 and 13. In addition, housing 10 is provided with two pair of fluid passageways 29–30 and 31–32, with passageways 29 and 31 interconnecting valve chambers 12 and 13 with power chamber or cylinder 11, but on opposite sides of piston 18, and passageways 30 and 32 interconnecting valve chambers 12 and 13 with high pressure chambers or cylinders 14 and 15. Housing 10 additionally includes a pair of signal vent ports 33 and 34 in high pressure cylinders 14 and 15 located intermediate respective pistons or members 21–22 and 23–24. The pair of fluid inlet-outlet valve chambers 16 and 17 are in open communication with ends of high pressure cylinders 14 and 15, and each include an inlet port 35–36 for fluid to be pumped and an outlet port 37–38 for pumped fluid. Reciprocally mounted in each of valve chambers 12 and 13 is a valve member 39–40, each having a pair of pistons or members 41–42 and 43–44 interconnected by stems or rods 45–46, which move in different diameter sections 47–48 and 49–50 forming the valve chambers 12 and 13. Power fluid supply or intake ports 25 and 26 and fluid passageways 29 and 31 are connected to the smaller diameter sections 47 and 49; while power fluid exhausts ports 27 and 28 and fluid passageways 30 and 32 are connected to the larger diameter sections 48 and 50 of valve chambers 12 and 13. Fluid inlet outlet valve chambers 16 and 17 are provided with check or ball valve or members 51–52 and 53–54, which cooperate with respective seats 55–56 and 57–58, and function as known in the art.

In the example set forth above, the intake ports 35 and 36 of valve chambers 16 and 17 are connected to a supply of water to be pumped, such as a stream, lake, etc., and the outlet ports 37 and 38 of valve chambers 16 and 17 are connected to a point of use or to a storage tank, etc. Similarly, power fluid supply or intake ports 25 and 26 are connected to the same water supply as intake ports 35 and 36 of valve chambers 16 and 17, but power fluid exhaust ports 27 and 28, which must be at a lower pressure, may or may not be connected to the same point of use or storage tank as are outlet ports 37 and 38 of valve chambers 16 and 17. The exhaust must be at a low pressure, e.g., ambient or located further downstream or below lake level, for example. Also, while not shown, it is to be understood that the piston 18 in power chamber or cylinder 11, pistons or members 21–22 and 23–34 in high pressure chambers or cylinders 14 and 15, and the pistons or members 41–42 and 43–44 of valve members 39–40 in valve chambers 12 and 13, are each provided with an appropriate fluid seal, such as one or more o-rings, to prevent leakage of fluid therepast as these members or pistons move in their respective cylinders or chambers. Also, the valve seats 55–56 and 57–58 of valve chambers 16 and 17 may be formed of a different material, not shown, than the material of housing 10.

In operation, as shown in FIG. 1, power fluid via supply or intake port 25 enters valve chamber section 47 moving valve member 39 to the right, whereby the fluid enters passageway 29, chamber 11, an inner portion of cylinder 14, passageway 32 and into valve chamber section 50 moving valve member 40 to the right, whereby power fluid supply port 26 is blocked. As shown exhaust port 28 is open thereby venting passageway 31. Passageway 30 and an inner portion of cylinder 15 is vented via signal vent port 34, and an outer portion of cylinder 14 is vented via signal vent port 33, whereby piston 18 is moved to the right as shown by arrow 59 causing rods 19 and 20, along with their spaced pistons or members 21–22 and 23–24, to move to the right to the position shown in FIG. 2, wherein the power fluid supply is now only in valve chamber section 47, passageway 29 and in chamber or cylinder on the left side of piston 18 which has been moved to the right in cylinder 11. As piston 18 and rods 19–20 travel to the right, fluid to be pumped enters valve chamber 16 and is discharged from valve chamber 17, to a point of use, as indicated by the valve members 51 and 54 being raised from their seats 55 and 58, and as shown in FIG. 2, at the end of the stoke of piston 18 and rods 19–20, valve members 51 and 54 are again seated. Near the end of the stroke of piston 18 as shown in FIG. 2, member 22 has moved so that passageway 32 and chamber section 50 vent through port 33. With chamber section 50 vented the pressure of the power fluid in supply or intake port 26 in valve chamber 13 is sufficient to move the valve member 40 to the left as shown in FIG. 2, and as valve member 40 is moved further to the left, as shown in FIG. 3, it allows valve chamber section 49 to be connected to passageway 31 whereby the power fluid enters cylinder 11 at the right of piston 18, and passes into an inner portion of cylinder 15, through passageway 30 to valve chamber section 48 causing valve member 39 to move to the left blocking fluid passage from valve chamber 47 to passageway 29, see FIG. 3, due to the greater cross-sectional area on the face of valve member 42 compared to the cross-sectional area on the face of value member 41. While not shown in FIG. 3, valve member 39 continues its leftward movement to vent the left side of the power cylinder 11 out through passageway 29 and port 27. As the power fluid continues to fill the right side of power chamber 11 the piston 18 and connected rods 19 and 20 are moved to the left initiating a return stroke. As the return stroke begins, the state of the apparatus is opposite to that shown in FIG. 1, with precise symmetry. The return stroke causes the pump chamber 17 to fill and the pump chamber 16 to discharge to a point of use. Near the end of the return stroke of piston 18 (to the left), passageway 30 is vented through port 34 so that power fluid again enters supply or intake port 25 of valve chamber 12 and the sequence of FIGS. 1, 2 and 3 are repeated.

The embodiment of FIGS. 4–7, which omits the fluid pumping chamber 16 and 17, and the outer pistons or members 21 and 24 of the FIGS. 1–3 embodiment, illustrate an embodiment, similar to that of FIGS. 1–3, but designed to produce or transmit mechanical power rather than for intensifying the flow of fluid as in the FIGS. 1–3 embodiment. Also, the intake/exhaust valves in FIGS. 4–7 are located in separate housings from the power chamber housing. As shown in FIGS. 4–7 the fluid driven reciprocating apparatus generally indicated at 60 basically comprises a piston housing 61 and a pair of intake/exhaust valve housings 62 and 63. Located in housing 61 are three cylinder sections 64, 65 and 66 in which are located pistons 67, 68 an 69, with pistons 68 and 69 connected to piston 67 via rods 70 and 71. Housing 61 is provided with four ports or openings 72, 73, 74 and 75, with ports 72 and 74 being located in cylinder section 64, port 73 located in cylinder section 65, and port 75 located in cylinder section 66. Intake/exhaust valve housings 62 and 63 have chamber sections 76–77 and 78–79 with chamber sections 77 and 79 being larger in diameter than chamber sections 76 and 78. Valve chamber sections 76 and 78 includes ports 80–81 and 82–83, while valve chamber sections 77 and 79 includes ports 84–85 and 86–87. Ports 80 and 82 are connected to supply lines 88 and 89, which are connected to a fluid source indicated at 90. Port 81 is connected by line 91 to port 72 of housing 61, port 84 being connected to port 75 in housing 61 by a line 92, port 83 being connected by line 93 to port 74 of housing 61, port 86 being connected to port 73 of housing 61 via a line 94, with ports 85 and 87 open to atmosphere, for example.

Figure 4:
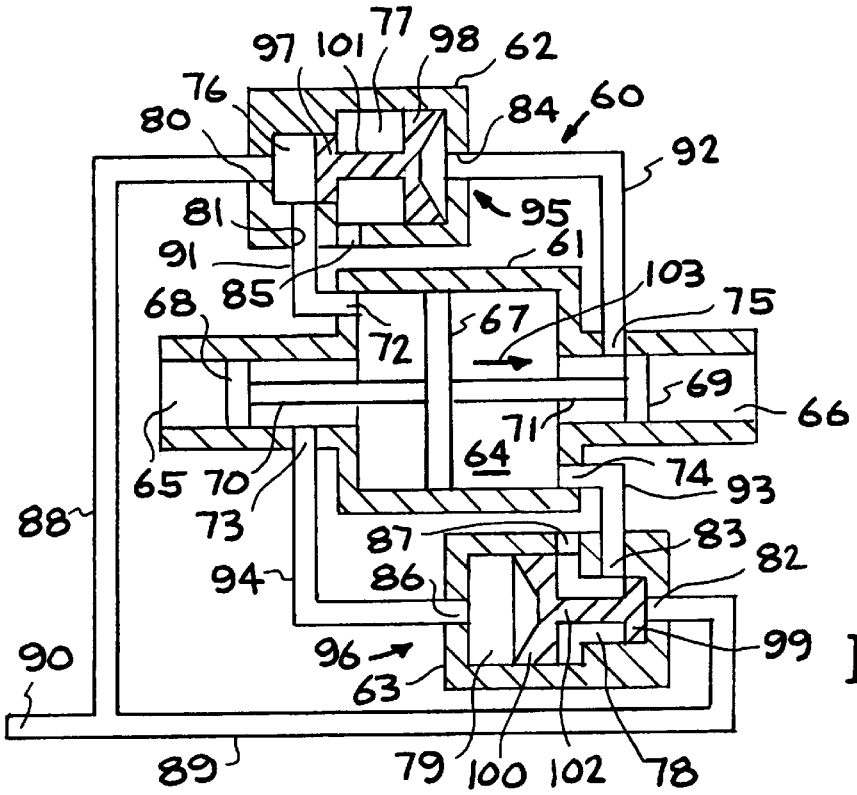
FIGS. 4, 5, 6 and 7 partially schematically illustrate in cross-section another embodiment of the double acting power chamber for the fluid intensifier with the intake-exhaust valves being in separate housings.

As shown in FIG. 4, with intake port 80 open and the exhaust port 87 open, fluid under pressure from fluid source 90 passes through line 88, port 80 and into valve chamber section 76 moving a valve member 95 to the right, and then through port 81, line 91, port 72, chamber section 64, an inner portion of chamber section 65, port 73, line 94, port 86, and into valve chamber section 79 moving a valve member 96 to the right thereby closing the port 82 connected to line 89. Valve members 95 and 96 have pistons or members 97–98 and 99–100 interconnected by stems 101 and 102, with pistons 98 and 100 having a larger cross-sectional area than pistons 97 and 99, whereby the valve members 95 and 96 are moved to the location shown in FIG. 4 due to the differential in pressure thereacross. As shown in FIG. 4, entry of pressurized fluid into cylinder section 64 causes piston 67 and connected pistons 68 and 69 to move to the right as indicated by arrow 103.

Figure 5:
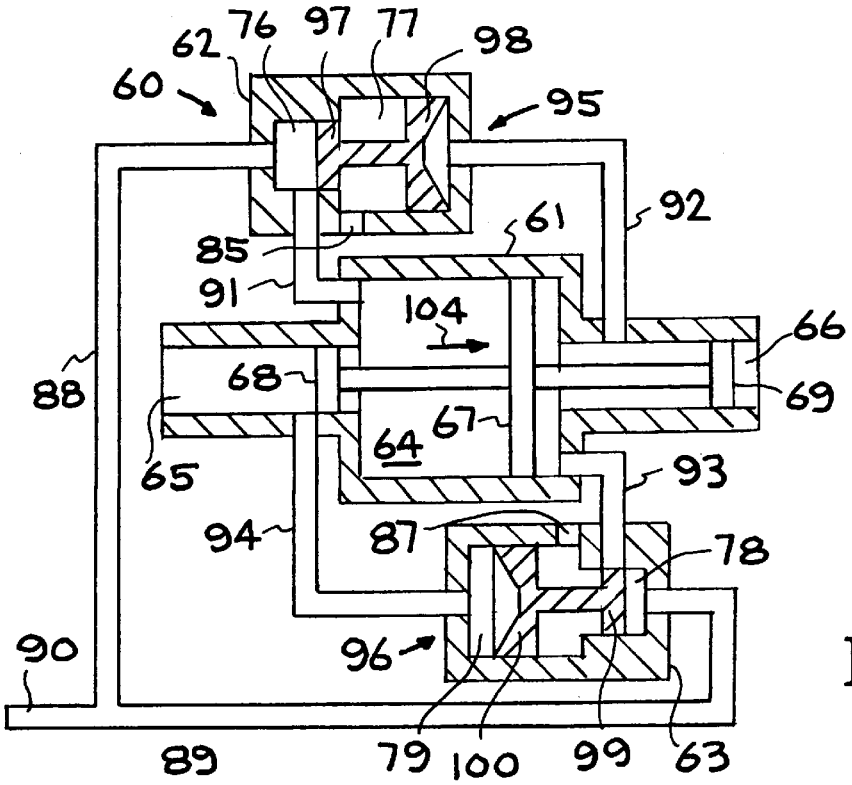
Figure 6:
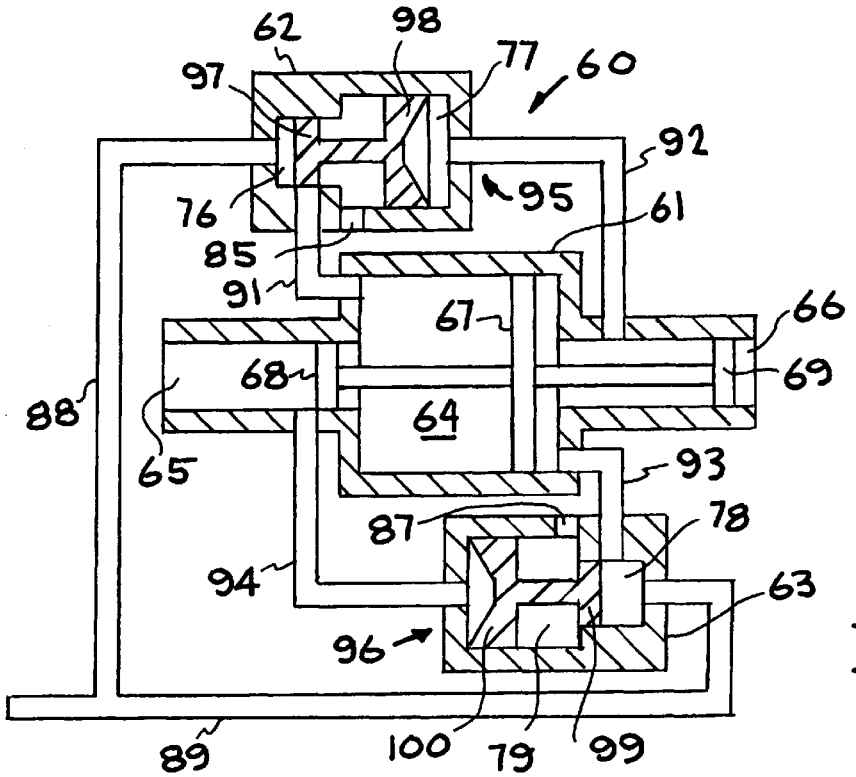
Figure 7:
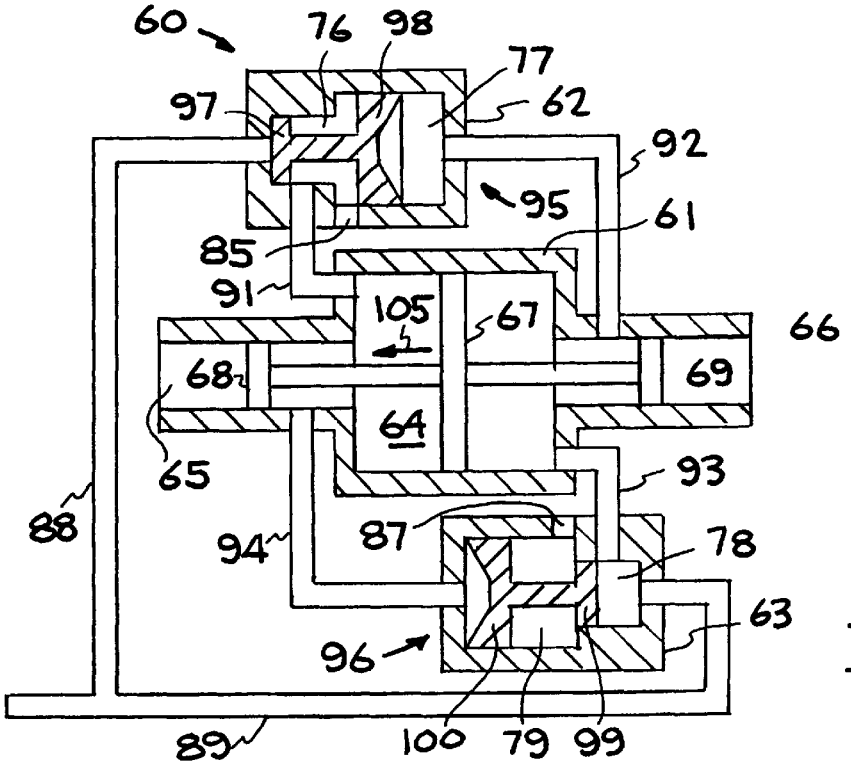

Piston 67 continues to move to the right as indicated by arrow 104 in FIG. 5 to a switching position when piston 67 nears the end of its rightward stroke in chamber section 64 of housing 61. At the switching point, as shown in FIG. 5, piston or member 68 has moved past port 73, whereby the fluid pressure is exhausted from valve chamber section 79, and the fluid pressure in line 89 via port 82 acts against valve piston 99 causing it to move to the left, as seen in FIG. 5, whereby the fluid pressure is only in valve chamber section 76, line 91 and housing cylinder section 64, as shown. Further movement of valve 96 to the left initiates a switching action which causes fluid from source 90 to enter line 93, the cylinder section 64 at the right of piston 67, and inner section of cylinder section 66, line 92 and into valve chamber section 77 cause valve member 95 to move to the left as shown in FIG. 6, wherein the valve member 95 is in a switching mode and valve member 96 has its intake open. As the valve member 95 continues to move to the left, the fluid under pressure into valve chamber section 76 is blocked as shown in FIG. 6. Continued movement to the left of valve member 95 causes valve piston 97 to uncover port 81, whereby fluid on the left side of the piston 67 is exhausted via chamber section 76, chamber section 77 and exhaust port 85, as shown in FIG. 7, whereby the piston 67 and connected pistons 68 and 69 move to the left as shown by arrow 105 in FIG. 7, and thus valve member 95 is in an exhaust open mode and valve member 96 is in an intake open mode, which will continue until piston 67 nears the end of its leftward stroke and the valve 95 and 96 initiate a switching action to reverse the movements of the pistons. It is understood that as pistons or members 68 and 69 move in either direction they transmit mechanical energy, such as may be used to drive a reciprocating device, such as a saw blade fluid motor. Also, as pointed out above, the pistons and valve pistons are provided with fluid seals, such as o-rings to prevent leakage of fluid therepast.

It has thus been shown that the present invention provides a simply constructed reciprocating fluid drive mechanism, which can be utilized as a fluid intensifier or as a mechanical energy transmitting device. The mechanism of this invention eliminates the need for complicated 4-way valve assemblies, as well as eliminating pilot valves for controlling movement piston direction. The invention can be used as a reciprocating air motor or as a hydraulic motor (oil or water), but is ideally suited to be used as a fluid pressure intensifier. For example, by using 100 psi air to drive the mechanism, the mechanism can deliver hydraulic fluid at 1000 psi; or it can be used for lifting water from a stream up to a house or storage tank located on a hill, by merely using the power of the water itself.

While particular embodiment of the invention have been illustrated and described to exemplify and teach the principles of the invention, such are not intended to be limiting. Modifications and changes may become apparent to those skilled in the art, and it is intended that the invention be limited only by the scope of the appended claims.

What is claimed is:

1. A fluid driven reciprocating apparatus, comprising a power cylinder having a double acting piston therein, a pair of cylinders on opposite sides of said power cylinder and in open fluid communication therewith, a pair of signal rods mounted on opposite sides of said double acting piston and extending into said pair of cylinders, each of said pair of signal rods having at least one member thereon, each of said members being adapted to reciprocate in one of said pair of cylinders, a pair of intake/exhaust valve assemblies having a valve member therein, for controlling passage of fluid through said power cylinder, each of said intake/exhaust valve assemblies being in fluid communication with said power cylinder on an opposite side of said double acting piston, and with one of said pair of cylinders, each of said intake/exhaust valve assemblies having an exhaust port, and an intake port adapted to be connected to a source of driving fluid.

2. The apparatus of claim 1, wherein said power cylinder, said pair of cylinders, and said intake/exhaust valve assemblies are located in one housing.

3. The apparatus of claim 1, wherein said power of cylinder and said pair of cylinders are located in one housing, and each of said valve assemblies are located in separate housings.

4. The apparatus of claim 1, wherein each of said pair of signal rods is provided with two spaced members thereon, said two spaced members being located on said signal rod such that a vent in each of said pair of cylinders is located intermediate each pair of said two spaced members.

5. The apparatus of claim 4, additionally including a pair of inlet/outlet valve assemblies mounted in fluid communication with an outer end of each of said pair of cylinders.

6. The apparatus of claim 1, wherein each of said intake/exhaust valve assemblies includes a pair of interconnected, different diameter chamber sections, a smaller diameter chamber section having an intake port therein, and being connected in fluid communication to said power cylinder; a larger diameter chamber section having an exhaust port therein, and being connected in fluid communication one of said pair of cylinders; said valve member of each intake/exhaust valve assembly including two different diameter sections adapted to move within said pair of interconnected, different diameter chamber sections.

7. The apparatus of claim 6, wherein said two different diameter sections of said valve member comprises a pair of different diameter members interconnected by a still smaller diameter section.

8. In a fluid intensifier including a power cylinder having double acting piston therein, a pair of high pressure cylinders having at least one piston therein connected to said double acting piston, and valving for controlling fluid to at least said double acting piston, the improvement including:

said valving for controlling fluid comprising a pair of intake/exhaust valves each operatively connected to said power cylinder containing said double acting piston and to one of said pair of high pressure cylinders.

9. The improvement of claim 8, additionally including a pair of signal rods connected to said double acting piston and to said at least one piston in said pair of high pressure cylinders, for controlling said pair of intake/exhaust valves.

10. The improvement of claim 10, wherein each of said pair of signal rods includes a pair of spaced pistons, and wherein each of said pair of high pressure cylinders is provided with a vent located intermediate said pair of spaced pistons.

11. The improvement of claim 8, wherein each of said intake/exhaust valves, said power cylinder, and said pair of high pressure cylinders are located in one housing.

12. The improvement of claim 8, wherein each of said intake/exhaust valves includes a pair of different diameter chamber sections in which is located a valve member having different diameter sections.

13. The improvement of claim 12, wherein a smaller of said different diameter chamber sections is provided with an intake port, and is connected to one side of said power cylinder; and wherein a larger of said different diameter chamber sections is provided with an exhaust port, and is connected to one of said high pressure cylinders.

14. The improvement of claim 12, wherein said different diameter sections of said valve member comprises a pair of different diameter members interconnected by a stem.

15. In the fluid intensifier of claim 8, each of said pair of high pressure cylinders being connected at an outer end thereof to a fluid inlet/outlet valve assembly, each inlet/outlet valve assembly including an inlet port, an outlet port, and valve members for controlling said inlet and outlet ports, said inlet port being adapted to be connected to a fluid supply, and said outlet port being adapted to be connected to a point of use, whereby movement of said double acting piston causes movement of said at least one piston in each of said high pressure fluid, whereby fluid is drawn in through said inlet port and discharged through said outlet port of each inlet/outlet valve assembly, thereby intensifying pressure of fluid entering the inlet ports.

* * * * *